United States Patent [19]

Duerksen

[11] Patent Number: 5,014,787

[45] Date of Patent: May 14, 1991

[54] SINGLE WELL INJECTION AND PRODUCTION SYSTEM

[75] Inventor: John H. Duerksen, Fullerton, Calif.

[73] Assignee: Chevron Research Company, San Francisco, Calif.

[21] Appl. No.: 394,687

[22] Filed: Aug. 16, 1989

[51] Int. Cl.[5] ..... E21B 43/24

[52] U.S. Cl. ..... 166/303; 166/306; 166/313; 166/387

[58] Field of Search ..... 166/250, 251, 252, 258, 166/263, 268, 272, 297, 298, 302, 303, 313, 369, 370, 387, 52, 57, 62, 106, 191, 306

[56] References Cited

U.S. PATENT DOCUMENTS

| | | | |
|---|---|---|---|
| 3,116,792 | 1/1964 | Purre | 166/258 X |
| 3,126,961 | 3/1964 | Craig, Jr. et al. | 166/303 |
| 3,159,215 | 12/1964 | Meldau et al. | 166/258 |
| 3,180,413 | 4/1965 | Willman | 166/272 |
| 3,182,722 | 5/1965 | Reed | 166/258 |
| 3,273,640 | 9/1966 | Huntington | 166/272 X |
| 3,349,846 | 10/1967 | Trantham et al. | 166/258 X |
| 3,358,756 | 12/1967 | Vogel | 166/272 X |
| 3,361,202 | 1/1968 | Whipple | 166/306 X |
| 3,379,247 | 4/1968 | Santourian | 166/272 |
| 3,386,508 | 6/1968 | Bielstein et al. | 166/272 |
| 3,599,714 | 8/1971 | Messman et al. | 166/258 |
| 3,994,341 | 11/1976 | Anderson et al. | 166/303 X |
| 4,362,213 | 12/1982 | Tabor | 166/303 X |
| 4,488,598 | 12/1984 | Duerksen | 166/272 X |
| 4,595,057 | 6/1986 | Deming et al. | 166/57 X |
| 4,601,338 | 7/1986 | Prats et al. | 166/303 X |
| 4,753,293 | 6/1988 | Bohn | 166/272 X |

*Primary Examiner*—George A. Suchfield

*Attorney, Agent, or Firm*—Edward J. Keeling; Robert D. Touslee; David J. Power

[57] ABSTRACT

A method is disclosed for fluid injection and oil production from a single wellbore which includes providing a path of communication between the injection and production zones.

7 Claims, 1 Drawing Sheet

SINGLE WELL INJECTION AND PRODUCTION SYSTEM

BACKGROUND OF THE INVENTION

This invention relates generally to the production of containing formations. Deposits of highly viscous crude petroleum represent a major future resource in the United States in Ca. and Ut., where estimated remaining inplace reserves of viscous or heavy oil are approximately 200 million barrels. Overwhelmingly, the largest deposits in the world are located in Alberta Province Canada, where the in-place reserves approach 1,000 billion barrels from depths of about 2,000 feet to surface outcroppings and at viscosities of up to 1 million c.p. at reservoir temperature. Until recently, the only method of commercially recovering such reserves was through surface mining at the outcrop locations. It has been estimated that more than 90% of the total reserves are not recoverable through surface mining operations. Various attempts at alternative, in-situ methods, have been made, all of which have used a form of thermal steam injection. Most pilot projects have established some form of communication within the formation between the injection well and the production well. Controlled communication between the injector and producer wells is critical to the overall success of the recovery process because in the absence of control, injected steam will tend to override the oil-bearing formation in an effort to reach the lower pressure area in the vicinity of the production well. The result of steam override or breakthrough in the formation is the inability to heat the bulk of the oil within the formation, thereby leaving it in place. Well-to-well communication has been established in some instances by inducing a pancake fracture However, often problems arise from the healing of the fracture, both,. from formation forces and the cooling of mobilized oil as it flows through a fracture towards the producer. At shallower depths, hydraulic fracturing is not viable due to lack of sufficient overburden. Even in the case where some amount of controlled communication is established, the production response is often unacceptably slow.

U.S Pat. No. 4,037,658 to Anderson teaches a method of assisting the recovery of viscous petroleum such as from tar sands by utilizing a controlled flow of hot fluid in a flow path within the formation but out of direct contact with the viscous petroleum; thus a solid-wall, hollow tubular member in the formation is used for conducting hot fluid to reduce the viscosity of the petroleum to develop a potential passage in the formation outside the tubular member into which a fluid is injected to promote movement of the petroleum to a production position.

The method and apparatus disclosed by the Anderson patent and related applications is effective in establishing and maintaining communication within the producing formation, and has been termed the Heated Annulus Steam Drive, or "HASDrive", method. In the practice of HASDrive, a hole is formed through the petroleum-containing formation and a solid wall hollow tubular member is inserted into the hole to provide a continuous, uninterrupted flow path through the formation. A hot fluid is flowed through the interior of the tubular member out of contact with the formation to heat viscous petroleum in the formation outside the tubular member to reduce the viscosity of at least a portion of the petroleum adjacent the outside of the tubular member thereby providing a potential passage for fluid flow through the formation adjacent to the outsIde ot lhe lubuIar member. A drive fluid is then injected into the formation to promote movement of the petroleum for recovery from the formation.

U.S. Pat. No. 4,565,245 to Mims describes a well completion for a generally horizontal well in a heavy oil or tar sand formation. The apparatus disclosed by Mims includes a well liner, a single string of tubing, and an inflatable packer which forms an impervious barrier and is located in the annulus between the single string of tubing and the well liner. A thermal drive fluid is injected down the annulus and into the formation near the packer. Produced fluids enter the well liner behind the inflatable packer and are conducted up the single string of tubing to the wellhead. The method contemplated by the Mims patent requires the hot stimulating fluid be flowed into the well annular zone formed between the single string of tubing and the wellhead. The method contemplated by the Mims patent requires the hot stimulating fluid be flowed into the well annular zone formed between the single string of tubing and the casing. Unlike the present invention such concentric injection of thermal fluid, where the thermal fluid is steam, would ultimately be unsatisfactory due to scale build up in the annulus. The scale is a deposition of solids such as sodium carbonate and sodium chloride, normally carried in the liquid phase of the steam as dissolved solids, and are deposited as a result of heat exchange between the fluid in the tubing and the fluid in the annulus.

The use of parallel tubing strings, as in the apparatus disclosed in U.S. Pat. No. 4,595,057 to Deming, is a configuration in which at least two tubing strings are placed parallel in the well bore casing. Parallel tubing has been found to be superior in minimizing scaling and heat loss during thermal well operations.

It is now found desirable toward achieving an improved heavy oil recovery from a heavy oil containing formation to utilize a multiple tubing string completion in a single well bore, such well bore serving to convey both injection fluids to the formation and produced fluids from the formation. The injection and production would optimally occur simultaneously, in contrast to prior cyclic steaming methods which alternated steam and production from a single well bore.

To realize the advantages of this invention, it is not necessary the well bore be substantially horizontal relative to the surface, but may be at any orientation within the formation. By forming a fluid barrier within the well bore between the terminus of the injection tubing string and the terminus of the production tubing string; and exhausting the injection fluid near the barrier while injection perforations are at a greater distance along the well bore from the barrier, a well bore casing is effective in mobilizing the heavy oil in the formation nearest the casing by conduction heat transfer.

The improved heavy oil production method disclosed herein is thus effective in establishing communication between the injection zone and production zone through the ability of the well bore casing to conduct heat from the interior of the well bore to the heavy oil in the formation near the well bore. At least a portion of the heavy oil in the formation near the well bore casing would be heated, its viscosity lowered and thus have a greater tendency to flow. The single well method and apparatus of the present invention in operation therefore accomplishes the substantial purpose of an injection well, a production well, and a means of establishing communication therebetween. A heavy oil reservoir may therefore be more effectively produced by employing the method and apparatus of the present invention in a plurality of wells, each well bore having therein a means for continuous thermal drive fluid injection simultaneous with continuous produced fluid production and multiple tubing strings. The present invention therefore forms, a comprehensive system for recovery of highly viscous crude oil when practiced along with conventional equipment of the type well known in the generation of thermal injection fluide for the recovery of heavy oil.

DESCRIPTION OF THE PREFERRED EMBODIMENTS

Figure 1:
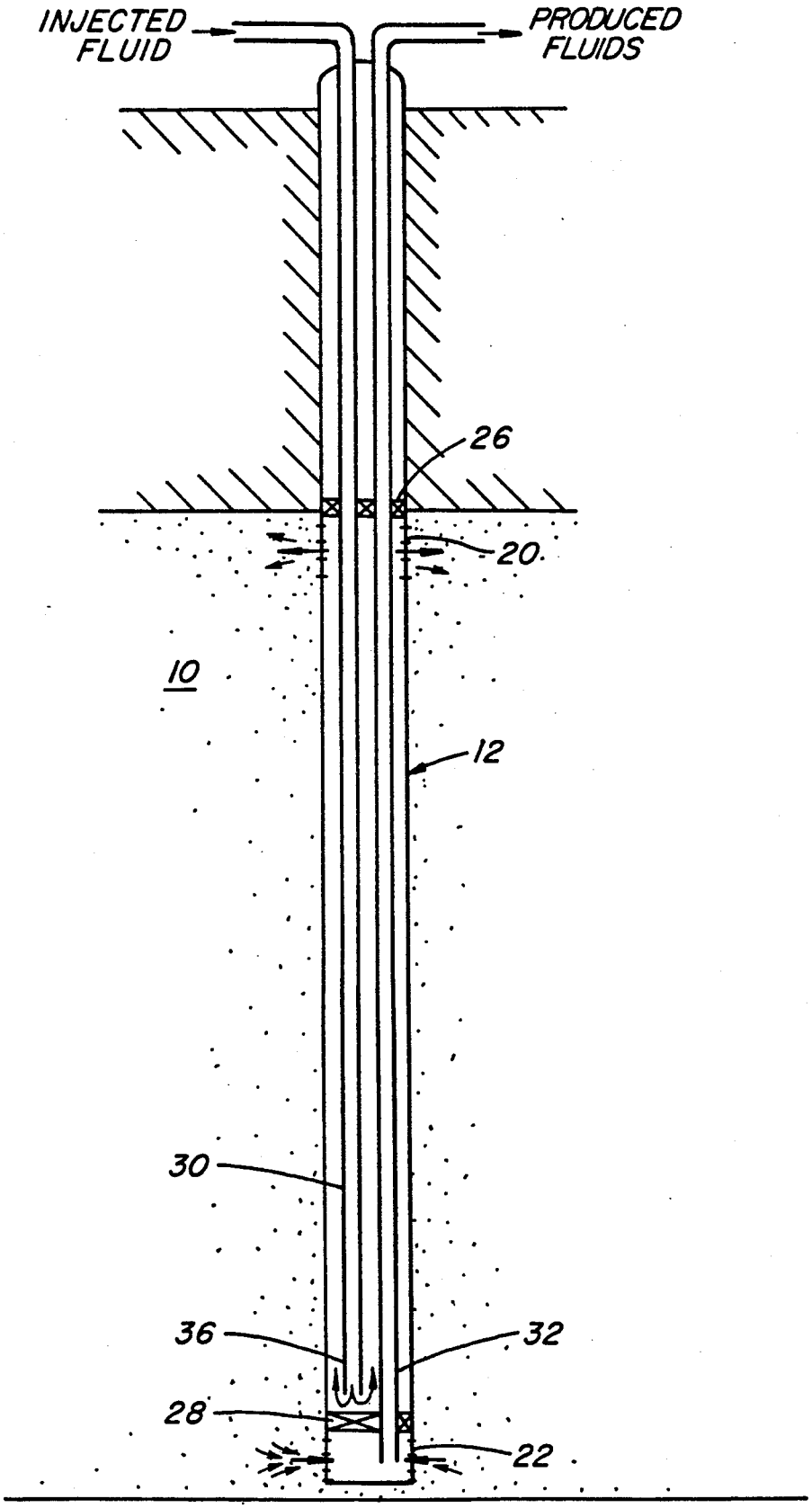
FIG. 1 is an elevation view in cross section of the single well injector and producer contemplated.

In the exemplary apparatus for practicing the present invention, as depicted by FIG. 1, a subterranean earth formation 10 is penetrated by a wellbore having a casing 12. Upper perforations 20 and lower perforations 22 provide fluid communication from the wellbore interior to the earth formation 10. A top packer 26 and bottom packer 28 are placed above the perforations 20 and 22 respectively.

A second tubing string 30 and first tubing string 32 are placed within the wellbore casing 12, both tubing strings extending through top packer 26. Second tubing string 30 terminates at a depth shallower in the wellbore than bottom packer 28. An annular-like injection fluid flow path 36 is created by the space bounded by the top packer packer 26, bottom packer 28, and within the well bore casing 12 exterior of either tubing string. First tubing string 32 further extends through bottom packer 28, terminating at a depth below bottom packer 28.

In a preferred embodiment, second tubing string 30 is supplied with pressured injection fluid from an injection fluid supply source (not shown). Injection fluid flows down second tubing string 30, exhausting from the terminus of the tubing string into the annular-like injection fluid flow path 36. Continual supply of high pressure injection fluid to the second tubing string 30 forces the injection fluid upward the annular flow path 36, toward the relatively lower pressured earth formation 10, through upper perforations 20. In the preferred embodiment of the present invention, the injection fluid is steam. When steam flows up the annular flow path 36 bounded by casing 12, thermal energy is conducted through the wellbore casing 12, and heating at least a portion of the earth formation 10 near the wellbore.

Hydrocarbon containing fluid located within the earth formation 10 near the wellbore casing, having now an elevated temperature and thus a lower viscosity over that naturally occurring in situ, will tend to flow along the heated flow path exterior of the casing 12. This heated flow path is formed near the wellbore casing 12 by heat conducted from steam flow in the annular-like flow path 36 on the interior of the casing 12, causing fluid to flow toward the relatively lower pressure region near lower perforations 22. In operation of the preferred embodiment, produced fluids comprising hydrocarbons and water including condensed steam enters from the earth formation 10 through lower casing perforations 22 to the interior of the wellbore casing 12 below bottom packer 28. Produced fluids are continously flowed into second tubing string 32 and up the tubing string to surface facilities (not shown) for separation and further processing.

What is claimed is:

1. A method for multiple string fluid injection and production of viscous hydrocarbons from a single wellbore having a casing traversing a subterranean formation, comprising the steps of:

a. providing lower perforations to establish lower communication point between a lower portion of the formation and the inside of the casing;

b. providing upper perforations to establish upper communication point between an upper portion of the formation and the inside of the casing;

c. setting a single string packer within the casing above the lower point of communication to establish a production zone below the single string packer and a thermal zone above the single string packer;

d. setting a dual-string packer above the upper point of communication, said dual-string packer defining the upper boundary of the thermal zone;

e. introducing a first tubing string into the wellboro;

f. terminating the first tubing string at the production zone;

g. introducing a second tubing string paralleling the first tubing string into the wellboro;

h. terminating the second tubing string in the lower portion of the thermal zone; and i. flowing a drive fluid into the second tubing string and through the upper perforations wherein prior to entering the formation the drive fluid transfers heat to the wellbore casing to create a thermal communication path within the formation adjacent to the wellbore casing between the upper and lower perforations, said thermal communication path acting to direct at least a portion of the viscous hydrocarbons in the formation near the wellbore to the lower perforations for recovery;

j. simultaneous with step i., flowing a produced fluid from the production zone through the first tubing string for said recovery.

2. The method of claim 1 wherein the second tubing string is terminated low in the thermal zone substantially maximizing the physical distance within the thermal zone the drive fluid flowing from the tail of the second tubing string must travel prior to existing the wellbore through the upper perforations.

3. The method of claim 1 wherein the drive fluid is steam.

4. The method of claim 1 wherein the drive fluid is hot water.

5. The method of claim 1 wherein the flow of produced fluids from the production zone is facilitated with a pump.

6. The method of claim 1 wherein the flow of produced fluids from the production zone is accomplished by maintaining the bottom hole at a pressure sufficient to force the produced fluids to the wellbore surface.

7. The method of claim 1 further comprising the step of:

insulating the second tubing string between the second packer and the first packer to minimize heat transfer between fluid in the first tubing string and fluid in the second tubing string.

* * * * *